US012320085B2

(12) United States Patent
Kirchmair et al.

(10) Patent No.: US 12,320,085 B2
(45) Date of Patent: Jun. 3, 2025

(54) SNOW GROOMER VEHICLE WITH AUTOMATED FUNCTIONS AND METHOD FOR CONTROLLING A SNOW GROOMER VEHICLE

(71) Applicant: PRINOTH S.P.A., Vipiteno (IT)

(72) Inventors: Martin Kirchmair, Pfons (AT); Alberto Paoletti, Vipiteno (IT); Richard Casartelli, Wiesen / Pfitsch (IT)

(73) Assignee: PRINOTH S.P.A., Vipiteno (IT)

( * ) Notice: Subject to any disclaimer, the term of this patent is extended or adjusted under 35 U.S.C. 154(b) by 900 days.

(21) Appl. No.: 17/292,930

(22) PCT Filed: May 3, 2019

(86) PCT No.: PCT/IB2019/053647
§ 371 (c)(1),
(2) Date: May 11, 2021

(87) PCT Pub. No.: WO2020/104860
PCT Pub. Date: May 28, 2020

(65) Prior Publication Data

US 2022/0002958 A1 Jan. 6, 2022

(30) Foreign Application Priority Data

Nov. 20, 2018 (IT) ..... 102018000010464

(51) Int. Cl.
*E01H 4/02* (2006.01)

(52) U.S. Cl.
CPC ..... *E01H 4/02* (2013.01)

(58) Field of Classification Search
CPC ..... E01H 4/02; E01H 2004/026
See application file for complete search history.

(56) References Cited

U.S. PATENT DOCUMENTS 8,639,416 B2 * 1/2014 Jones ..... G05D 1/0278 701/41
9,050,725 B2 * 6/2015 Shull ..... B25J 9/1664
(Continued)

FOREIGN PATENT DOCUMENTS

CA 2256172 A1 6/2000
CA 2355057 A1 6/2000
(Continued)

OTHER PUBLICATIONS

Office Action and Search Report for Chinese Application No. 201980076122.X dated Oct. 27, 2022 (14 pages).
(Continued)

*Primary Examiner* — Dino Kujundzic
(74) *Attorney, Agent, or Firm* — Neal, Gerber & Eisenberg, LLP

(57) ABSTRACT

A snow groomer vehicle includes a frame, a tool connected to the frame through a front connecting device equipped with an actuator assembly operable to determine a relative position of the tool with respect to the frame, a satellite navigation device and a control system. The control system includes a processing unit and a memory device, containing a target map representing a desired surface to be obtained by processing the snowpack over a region. The processing unit determines a position and orientation of the frame from the data provided with satellite navigation device and determines a configuration of the tool as a function of the position and orientation of the frame and of the target map, so that the passage of the tool causes a removal of the snowpack that conforms the snowpack to the target map. The actuator assembly is operated so as to bring the tool into the determined configuration.

26 Claims, 13 Drawing Sheets

(56) References Cited

U.S. PATENT DOCUMENTS

| | | | | |
|---|---|---|---|---|
| 10,774,505 | B2 * | 9/2020 | Fujii | E02F 3/841 |
| 2002/0116122 | A1 | 8/2002 | Satonaka | |
| 2008/0195268 | A1 * | 8/2008 | Sapilewski | A01B 69/004 701/23 |
| 2009/0069987 | A1 * | 3/2009 | Omelchenko | E02F 9/2045 701/50 |
| 2014/0324291 | A1 * | 10/2014 | Jones | G05D 1/0274 701/41 |
| 2015/0240453 | A1 * | 8/2015 | Jaliwala | G01S 19/14 701/50 |
| 2020/0109532 | A1 * | 4/2020 | Betz | E01H 4/02 |
| 2020/0263389 | A1 * | 8/2020 | Harada | E02F 9/205 |

FOREIGN PATENT DOCUMENTS

| | | | |
|---|---|---|---|
| CA | 2642218 | A1 | 4/2010 |
| CN | 101918641 | A | 12/2010 |
| CN | 104131587 | A | 11/2014 |
| CN | 105133536 | A | 12/2015 |
| DE | 100 45 524 | A1 | 3/2002 |
| DE | 102016212326 | A1 | 1/2018 |
| EP | 3633107 | A1 | 4/2020 |
| WO | WO 01/16560 | A2 | 3/2001 |
| WO | WO 01/55511 | A2 | 8/2001 |

OTHER PUBLICATIONS

Notification Concerning Submission, Obtention or Transmittal of Priority Document for International Application No. PCT/IB2019/053647 dated Nov. 12, 2019.

International Search Report and Written Opinion for International Application No. PCT/IB2019/053647 dated Aug. 12, 2019.

Notice of Opposition for European Application No. 19729824.3 dated Jan. 10, 2023 (20 pages).

* cited by examiner

SNOW GROOMER VEHICLE WITH AUTOMATED FUNCTIONS AND METHOD FOR CONTROLLING A SNOW GROOMER VEHICLE

PRIORITY CLAIM

This application is a national stage application of PCT/IB2019/053647, filed on May 3, 2019, which claims the benefit of and priority to Italian Patent Application No. 102018000010464, filed on Nov. 20, 2018, the entire contents of which are each incorporated by reference herein.

TECHNICAL FIELD

The disclosure relates to a snow groomer vehicle with automated functions and to a method for controlling a snow groomer vehicle.

BACKGROUND

Prior to the present disclosure, the preparation of ski slopes required ever increasing care, both for safety reasons and because modern skiing equipments can be better exploited on regular surfaces, without marked irregularities and with a snowpack that is as homogeneous as possible. Moreover, many ski resorts now offer skiers the use of so-called snowparks, namely limited and restricted areas provided with structures dedicated to the execution of tricks, such as kicker and landing ramps with different configurations and degrees of difficulties, with bumps, boxes, rails, half-pipes and so on. The snowpack is processed by snow groomer vehicles, which are equipped with tools designed for this purpose. In particular, a snow groomer vehicle usually comprises a front mounted shovel or dozer blade as well as a rear tiller and finisher. The blade can be lifted, lowered and oriented so as to move a desired amount of snow, which, by so doing, can be removed, accumulated, distributed and shaped depending on the needs. The rear tool with tiller and finisher, on the other hand, allows users to obtain the desired finishing of the surface of the snowpack.

However, the quality obtained in the preparation of ski slopes and snowpark structures currently is, to a great extent, the result of the ability and of the experience of the operators of snow groomer vehicles, who almost completely control the working tools. Therefore, the achievable results, which are evidently affected by a relevant personal component, are scarcely repeatable and cannot be relatively easily optimized. This can lead, on the one hand, to non-homogeneous conditions, beyond what objective environmental factors would anyway allow, and, on the other hand, to a greater waste of time and resources because the processing steps are not carried out in an optimal manner.

On the contrary, the results should be much more uniform, especially in order to make up for the more limited abilities of those operators that are less skilled in the art.

SUMMARY

The object of the disclosure is to provide a snow groomer vehicle and a method for controlling a snow groomer vehicle, which overcome or at least attenuate certain of the drawbacks described above.

Therefore, according to the disclosure, there is provided a snow groomer vehicle comprising:

- a frame extending along a longitudinal axis;
- a tool connected to the frame through a connecting device equipped with an actuator assembly operable to determine a relative position of the tool with respect to the frame;
- a satellite navigation device;
- a control system including a processing unit and a memory device, containing a target map representing a desired surface to be obtained by processing the snowpack over a region; wherein the processing unit is configured to:
  - determine a position and an orientation of the frame using data provided by the satellite navigation device;
  - determine a configuration of the tool as a function of the position and orientation of the frame and of the target map, so that the passage of the tool causes a removal of the snowpack that conforms the snowpack to the target map; and
  - operate the actuator assembly so as to bring the tool into the determined configuration.

Therefore, the snow groomer vehicle is capable of determining, at least partly in an autonomous manner, the configuration of the tool in order to obtain the desired surface of the snowpack. In this way, on the one hand, the repeatability of the results is improved and, on the other hand, the difficulty in controlling the groomer vehicle is reduced, thus enabling the driver to pay more attention to the driving operations. As a consequence, generally speaking, the safety—especially for less skilled drivers—is improved as well. The snow groomer vehicle described herein can also be controlled in a remote manner.

According to a further aspect of the disclosure, the tool comprises a blade connected to the frame and the connecting device comprises a front connecting device connecting the blade to the frame.

According to a further aspect of the disclosure, the front connecting device comprises a front rigid structure hinged to the frame to be rotatable about a rotation axis and a universal joint connecting the blade to the front rigid structure and wherein the actuator assembly comprises:

- a first actuator unit configured to rotate the front rigid structure about the rotation axis to lift and lower the blade;
- a second actuator unit configured to rotate the blade creating a difference in level between opposite ends of the blade;
- a third actuator unit configured to determine a forward tilt of the blade; and
- a fourth actuator unit configured to place the blade perpendicular or at an angle with respect to a travelling direction.

The processing unit is configured to determine a first target profile in a travelling direction as an intersection of the target map and a first reference plane of the frame perpendicular to the rotation axis.

The intersection of the objective map and of the first reference plane of the frame enables to correlate the surface to be obtained with the current position of the snow groomer vehicle, which also represents the current surface of the snowpack in the spot being treated. This enables users to determine the thickness of the snowpack to be removed and the position to be assumed by the blade in order to obtain the programmed result.

According to a further aspect of the disclosure, the processing unit is configured to calculate a lifting angle of the blade relative to the frame about the rotation axis from an intersection of the first target profile and a trajectory in the first reference plane of an end of the front rigid structure opposite to the frame.

The lifting angle determined by so doing does not involve a significant computing burden and, at the same time, enables users to automatically set one of the most important parameters in the processing of the snowpack.

According to a further aspect of the disclosure, the processing unit is configured to determine a vertical inclination angle of the blade, defining an inclination of the blade in a vertical plane when the snow groomer vehicle is on a horizontal ground. The calculation of the vertical inclination angle enables users to refine the automatic processing of the snowpack, thus further improving the repeatability of the results.

According to a further aspect of the disclosure, the processing unit is configured to determine a lateral inclination angle, defining an inclination of the blade in a horizontal plane, when the snow groomer vehicle is on an horizontal ground. The calculation of the lateral inclination angle enables users to make up for possible differences between the trajectory of the snow groomer vehicle and an ideal trajectory for the desired processing, basically keeping the direction of the working front constant.

According to a further aspect of the disclosure, the processing unit is configured to use a model of the snow groomer vehicle comprising:

- a first polygon, representing the frame and having a side parallel to the rotation axis and a vertex coinciding with the rotation axis;
- a second polygon, representing the blade; and
- a segment, representing the front rigid structure and having an end hinged at the vertex of the first polygon and a second end connected to a midpoint of the base of the second polygon with three rotary degrees of freedom.

Such a model enables users to determine, with relative precision, the position and the configuration of the groomer vehicle without using significant calculation resources. This is advantageous both in terms of relative costs and in terms of speed in the execution of the procedures.

According to a further aspect of the disclosure, the tool comprises a tiller and finisher assembly and the connecting device comprises a rear connecting device connecting the tiller and finisher assembly to the frame.

According to a further aspect of the disclosure, the processing unit is configured to control a towing angle of the tiller and finisher assembly relative to the frame on the basis of the target map, of a curvature of a currently selected one from a plurality of programmed trajectories stored in the memory device and of the position, orientation and travelling direction determined by the satellite navigation device, so that the tiller and finisher assembly maintains a programmed orientation with respect to the programmed trajectory.

According to a further aspect of the disclosure, the processing unit is configured to set the towing angle and a yaw angle of the tiller and finisher assembly so as to control a lateral offset of the tiller and finisher assembly.

According to a further aspect of the disclosure, the processing unit is configured to control the lateral offset as a function of the programmed trajectory and of the position provided by the satellite navigation device so as to obtain a programmed overlap between adjacent processing strips.

According to a further aspect of the disclosure, the processing unit is configured to determine a cutting angle of the tiller and finisher assembly as a function of the target map and of the position provided by the satellite navigation device.

According to a further aspect of the disclosure, there is also provided a method for controlling a snow groomer vehicle, the snow groomer vehicle comprising a frame extending along a longitudinal axis; and a tool connected to the frame through a connection device equipped with an actuator assembly operable to determine a relative position of the blade with respect to the frame, wherein the method comprises:

- defining a target map representing a desired surface to be obtained by processing the snowpack over a region;
- determining a position and an orientation of the frame;
- determining a configuration of the tool as a function of the position and orientation of the frame and of the target map, so that the passage of the tool causes a removal of the snowpack that conforms the snowpack to the target map; and
- bringing the tool into the determined configuration.

BRIEF DESCRIPTION OF THE DRAWINGS

Further features and advantages of the disclosure will be best understood upon perusal of the following description of non-limiting embodiments thereof, with reference to the accompanying drawing, wherein.

DETAILED DESCRIPTION

Figure 1:
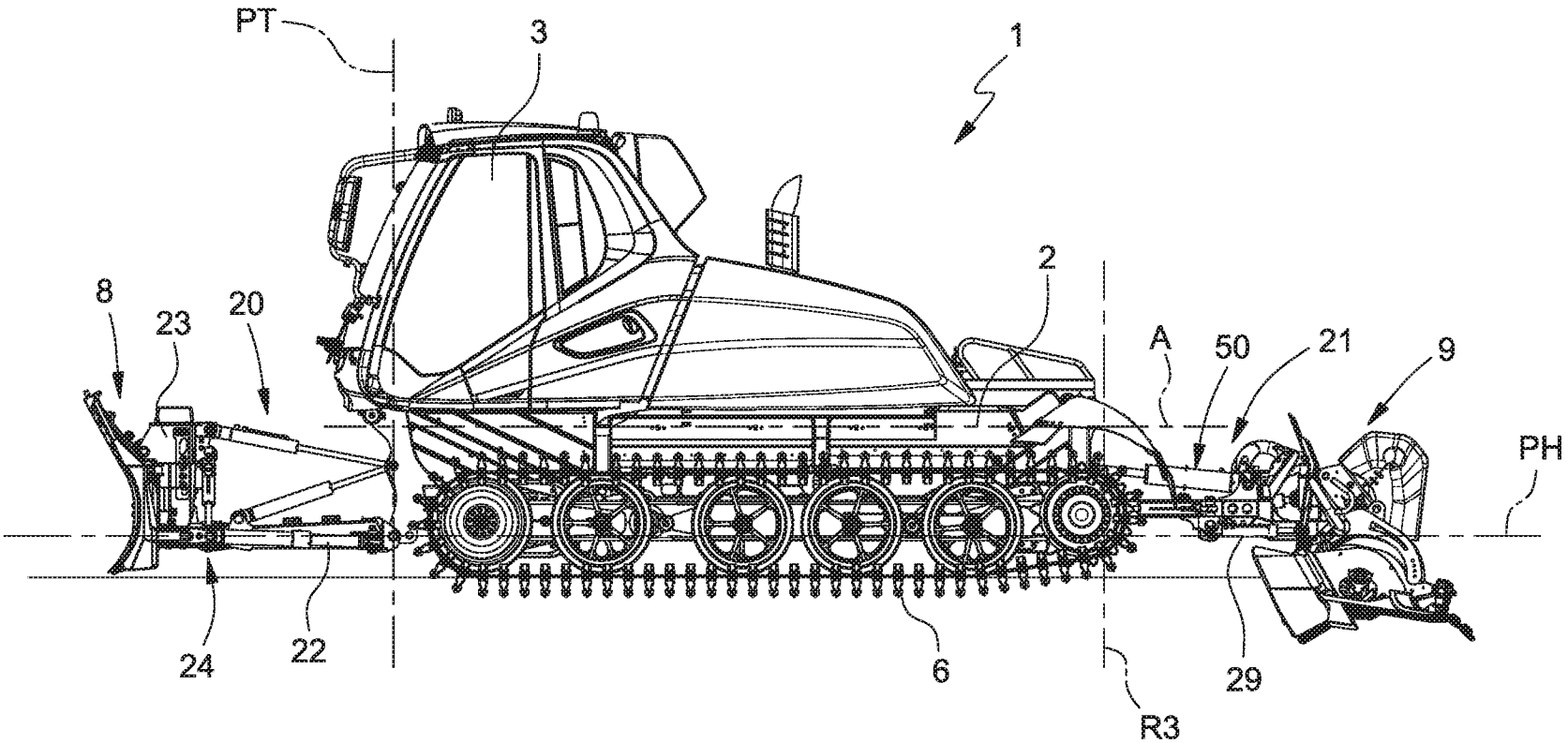
FIG. 1 is a side view of a snow groomer vehicle according to an embodiment of the disclosure.
Figure 2:
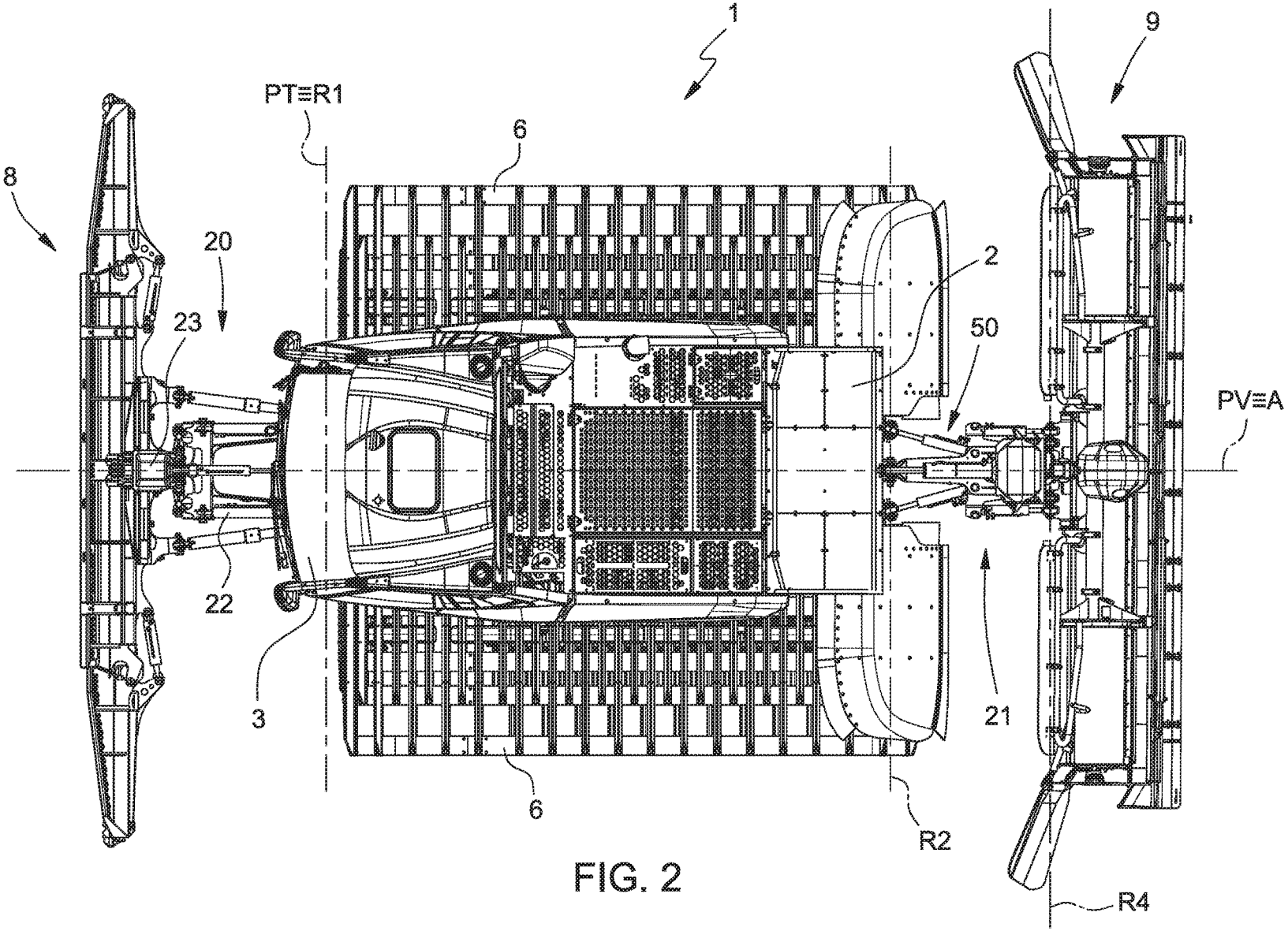
FIG. 2 is a plan view from the top of the snow groomer vehicle of FIG. 1.
Figure 3:
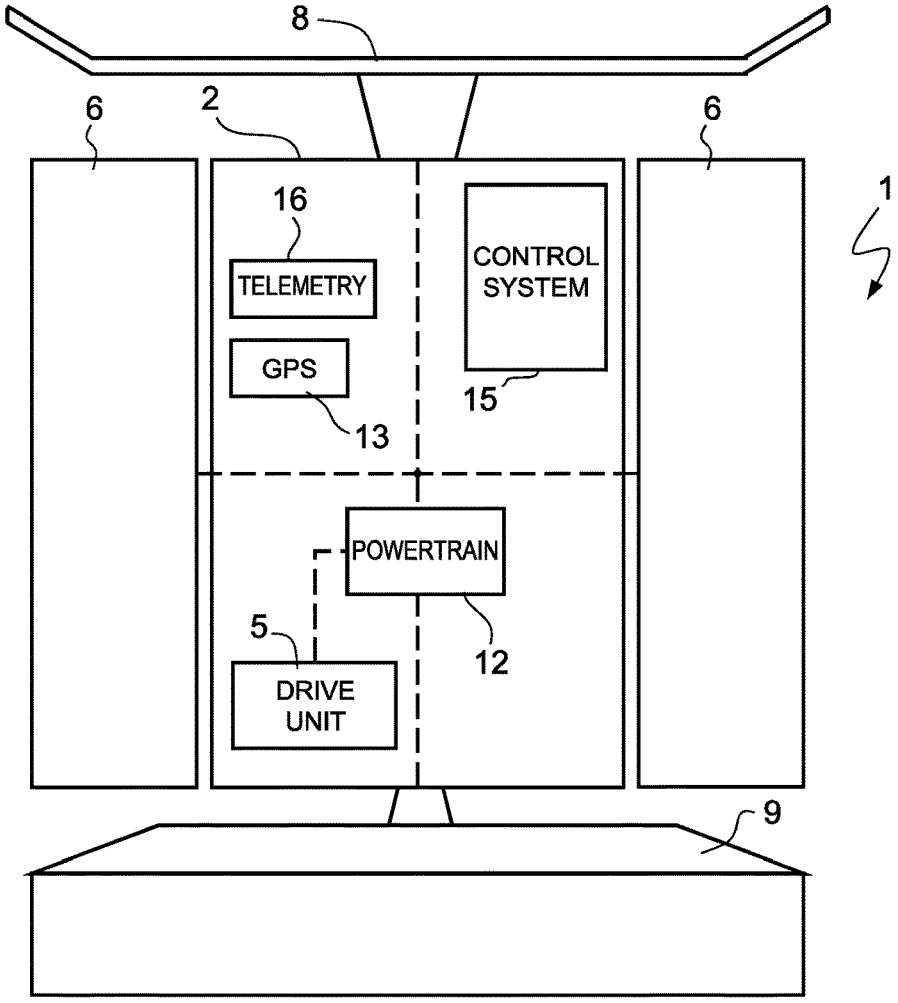
FIG. 3 is a simplified block diagram of the snow groomer vehicle of FIG. 1.

With reference to FIGS. 1 to 3, a snow groomer vehicle according to an embodiment of the disclosure is indicated, as a whole, with number 1 and comprises a frame 2, which extends along a longitudinal axis A (FIG. 2), a driver's cabin 3 and a drive unit 5 (FIG. 3), for example an internal combustion engine. The driver's cabin 3 and the drive unit 5 are housed on the frame 2. The snow groomer vehicle 1 is further provided with a pair of tracks 6 and with using devices, among which there are a blade or shovel 8 supported by the frame 2 at the front and a tiller and finisher assembly 9 supported by the frame 2 at the back. There may also be a winch assembly (which is not shown). A powertrain 12 (FIG. 3) is operatively coupled to the drive unit 5, which delivers the power needed for the operation of the snow groomer vehicle 1, and to the using devices. The powertrain 12 can be hydraulic or electric or a combination of hydraulic and electric.

In the driver's cabin 3 a user interface is installed (not shown), which enables an operator to control the travel of the snow groomer vehicle 1 and the operation of the using devices. Even though the snow groomer vehicle 1 is provided with control instruments and devices, which substantially enables for an autonomous operation, an operator can be present on board the snow groomer vehicle to increase security and, in this case, he/she can have the chance to force a manual control mode, bypassing the autonomous control, when the conditions require him/her to do so.

The snow groomer device 1 is provided with a satellite navigation device 13, with a control system 15 and with a telemetry system 16.

Figure 4:
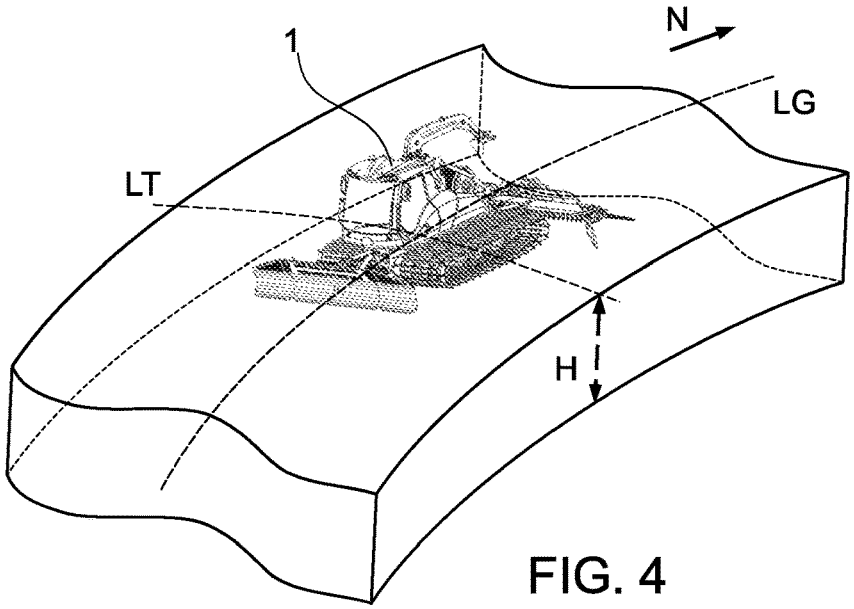
FIG. 4 shows coordinates that can be detected by a component of the snow groomer vehicle of FIG. 1.

The satellite navigation device 13, for example a GNSS ("Global Navigation Satellite System") device, is configured to determine, with a precision in the order of magnitude of centimetres, its position and three-dimensional orientation and, as a consequence, the position and three-dimensional orientation of the snow groomer vehicle 1. The satellite navigation system 13 enables operators to determine longitude LG, latitude LT and height from the ground H, besides the direction of a reference axis (FIG. 4). The height from the ground H corresponds to the thickness of the snowpack at the coordinates of the satellite navigation system 13 and of the snow groomer vehicle 1. The height from the ground H, in particular, may be determined from the difference between a height detected by the satellite navigation device 13 and a height from the ground defined by a reference map $M_R$ at a corresponding longitude LG and latitude LT. The reference map $M_R$ may be obtained using the satellite navigation device 13 in the absence of snow and may be stored in the satellite navigation system 13 or in the control system 15. In the first case, the height from the ground H is directly provided by the satellite navigation system 13; in the second case, the satellite navigation system 13 may provide a height relative to a reference height (for example, the sea level) and the height from the round H is determined by the control system 15 using the reference map $M_R$.

The control system 15 detects operating parameters of the snow groomer vehicle 1, such as, for example but not exclusively, the power delivered by the drive unit, the power absorbed by each one of the using devices, the position of the blade 8 and of the tiller and finisher assembly 9, the travelling speed of the snow groomer vehicle 1.

The control system 15 is provided with wireless connection abilities, for example directly through a local communication network or through a mobile data network and an Internet connection, for the connection to a resource managing system of a ski resort (which is not shown).

The blade 8 is connected to the frame 2 by a front connecting device 20, whereas the tiller and finisher assembly 9 is connected to the frame by a rear connecting device 21.

Figure 5:
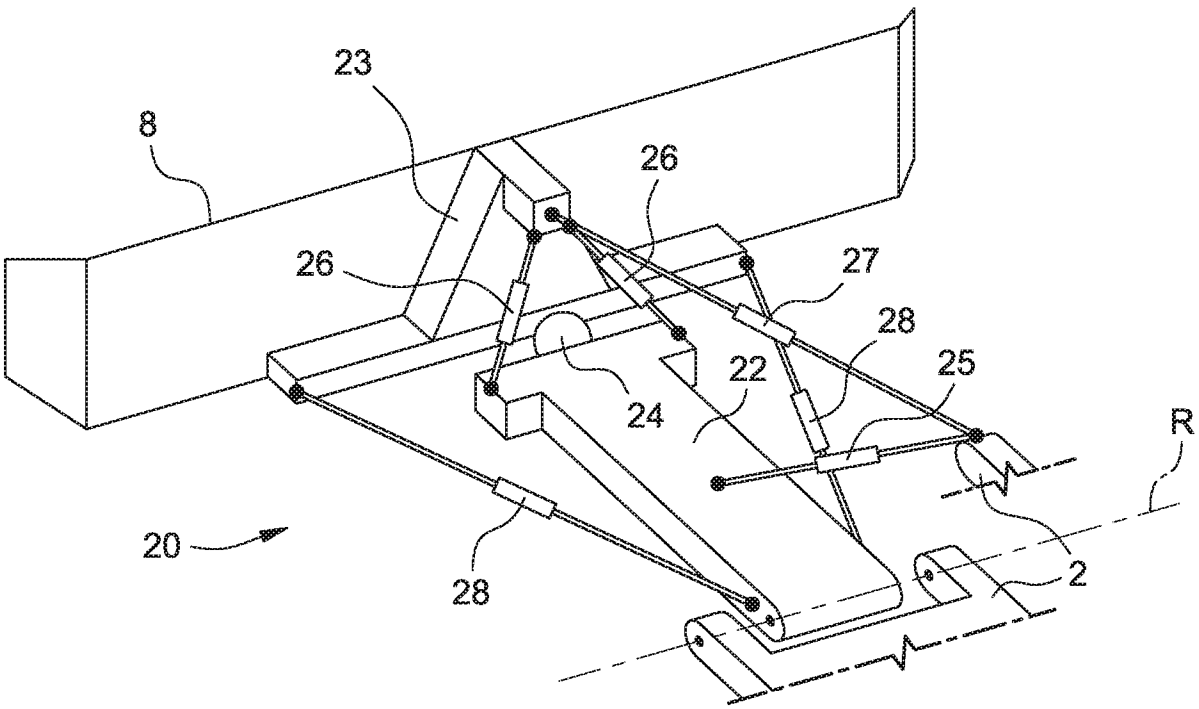
FIG. 5 is a perspective rear view of an enlarged detail of the snow groomer vehicle of FIG. 1.

The front connecting device 20 is shown in FIG. 5 and comprises a rigid structure 22 and a rigid structure 23. The rigid structure 22 is hinged to the frame 2 so as to rotate around a horizontal rotation axis R (when the snow groomer vehicle 1 is on level ground), which is parallel to the plane of the tracks 6. The rigid structure 23 is fixed to the blade 8 and is coupled to the rigid structure 22 by a universal joint 24, in particular a universal ball joint.

Figure 6:
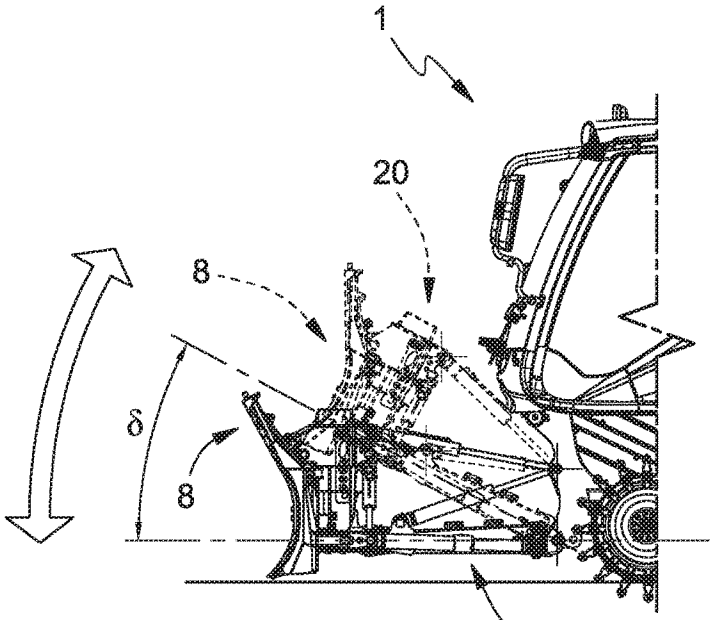
FIGS. 6 to 9 show the component of FIG. 5 in different use configurations.
Figure 7:
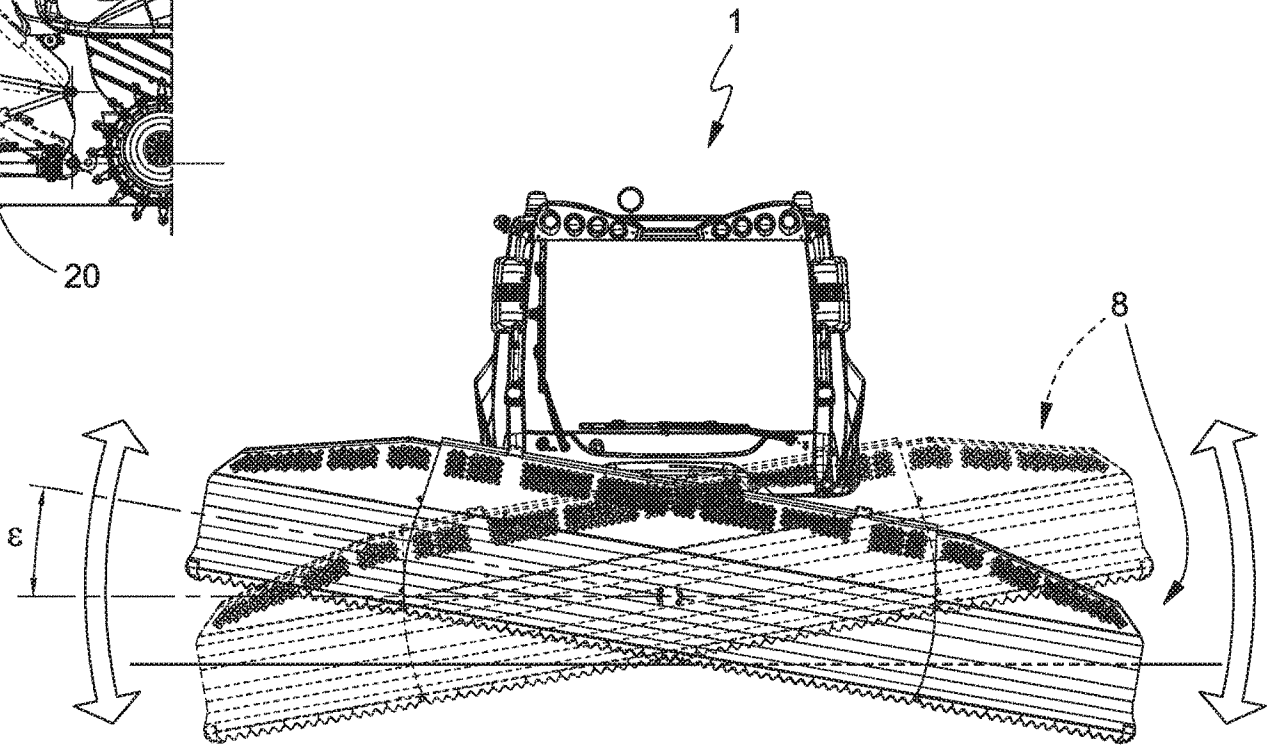
Figure 9:
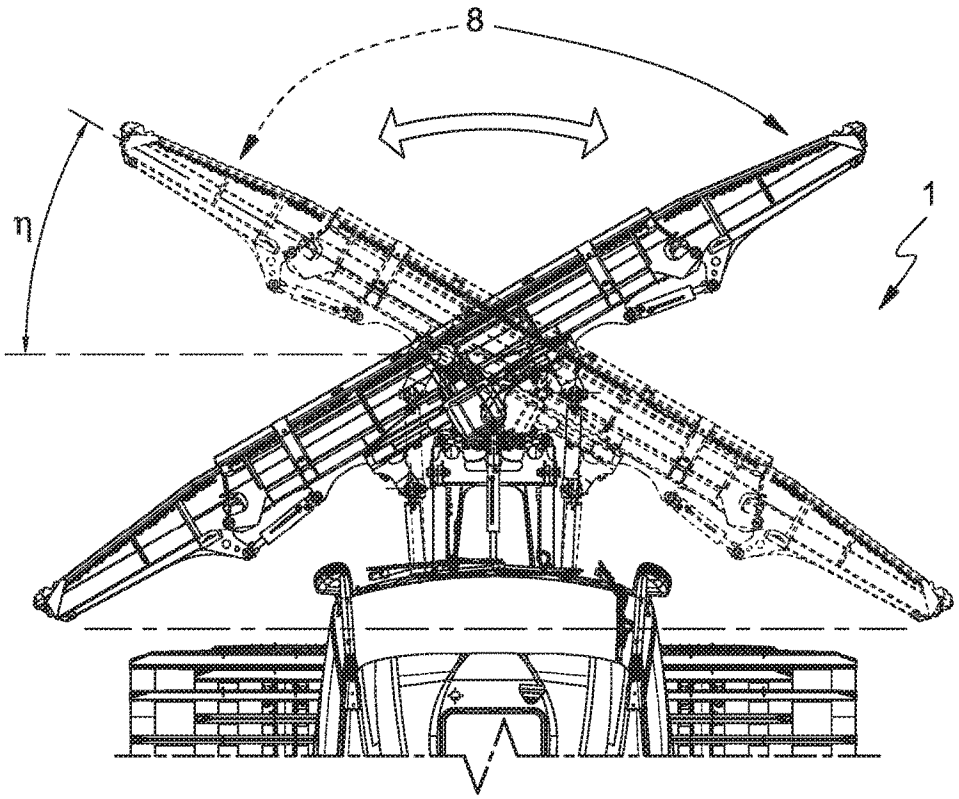
Figure 8:
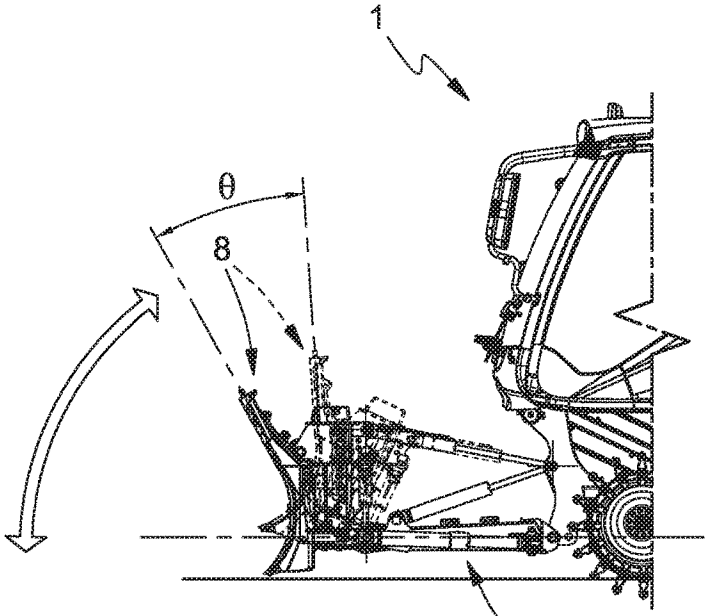

The front connecting device 20 further comprises:

- at least one actuator 25 to rotate the rigid structure 22 around the rotation axis R1 and lift and lower the blade 8 (FIG. 6);
- actuators 26 to rotate the blade 8 (vertical inclination or tilt; by creating a difference in level between the right and left ends of the blade 8 relative to the plane of the tracks 6, FIG. 7);
- at least one actuator 27 to determine the forward tilt or cutting angle of the blade 8 (FIG. 8); and
- actuators 28 to orient the blade 8, by placing the blade 8 perpendicular to or at an angle relative to the travelling direction of the snow groomer vehicle 1 (lateral inclination or tilt; FIG. 9).

A manual control device (not shown) to control the front connecting device 20 is housed in the driver's cabin 3 and enables operators to combine the four movements described and shown in FIGS. 6 to 9.

The rear connecting device 21 comprises a rigid structure 29 hinged to the frame 2 so as to rotate around a horizontal rotation axis R2 (when the snow groomer vehicle 1 is on level ground), which is parallel to a plane of the tracks 6 (which is parallel to the plane PH defined below) and to a rotation axis R3 (FIG. 1), which is perpendicular to the rotation axis R2 and belongs to a longitudinal plane longitudinally dividing the snow groomer vehicle into two substantially symmetric parts (plane PV defined below). Furthermore, the rear connecting device 21 supports a tiller and finisher assembly 9, enabling it to rotate around a rotation axis R4, which is horizontal when the snow groomer vehicle 1 is on level ground.

The rear connecting device 21 further comprises an actuator assembly 50 to: lift and lower the tiller and finisher assembly 9 rotating the rigid structure 29 around the rotation axis R2; orient the tiller and finisher assembly 9, by placing the blade 8 perpendicular to or at an angel relative to the travelling direction of the snow groomer vehicle 1; laterally translate the tiller and finisher assembly 9 relative to the frame 2; and determine a relative angular position of the tiller and finisher assembly 9 relative to the rear rigid structure 21 (cutting angle).

Figure 10:
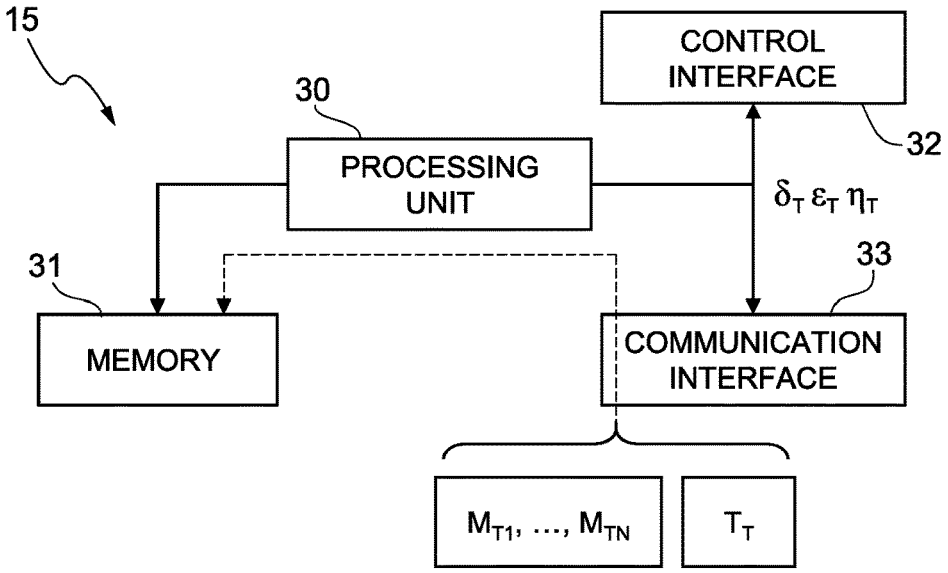
FIG. 10 is a more detailed block diagram concerning a control system of the snow groomer vehicle of FIG. 1.
Figure 12:
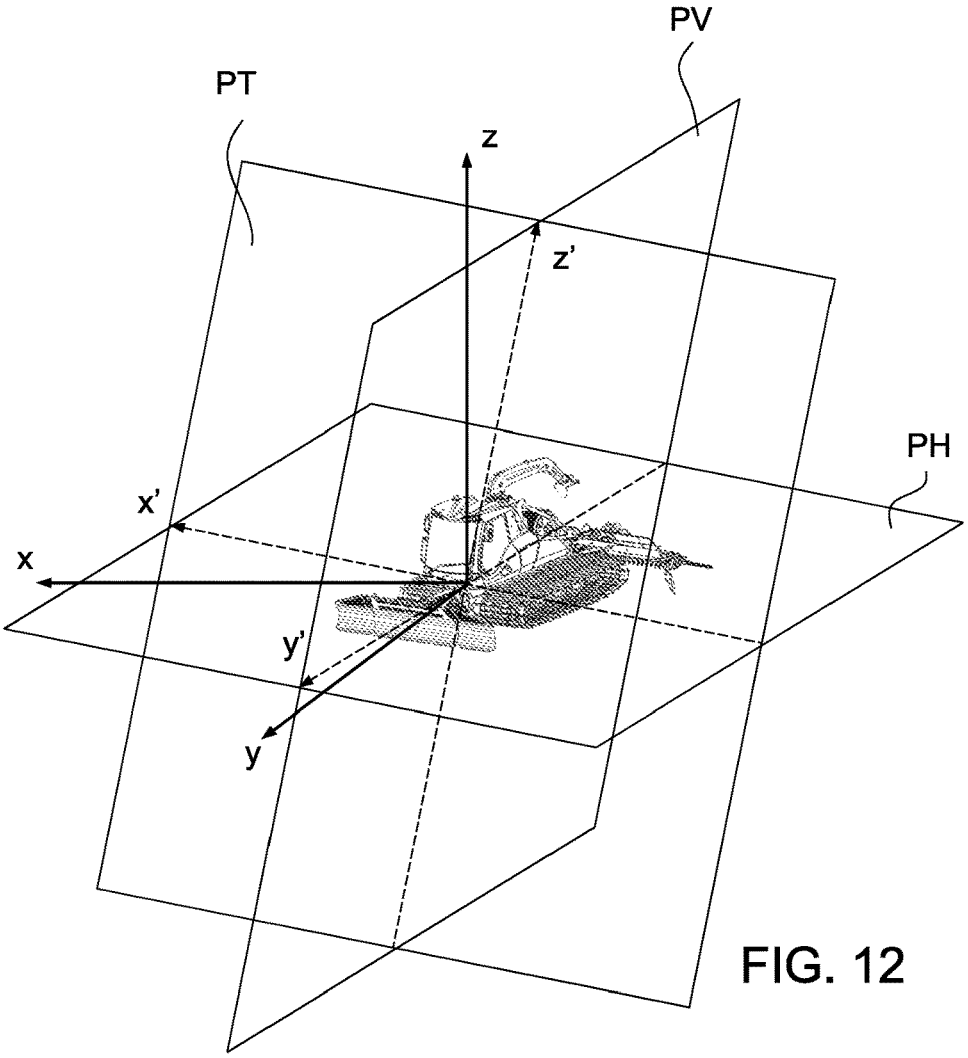
FIG. 12 shows systems and reference planes used in an embodiment of the control method according to the disclosure.
Figure 11:
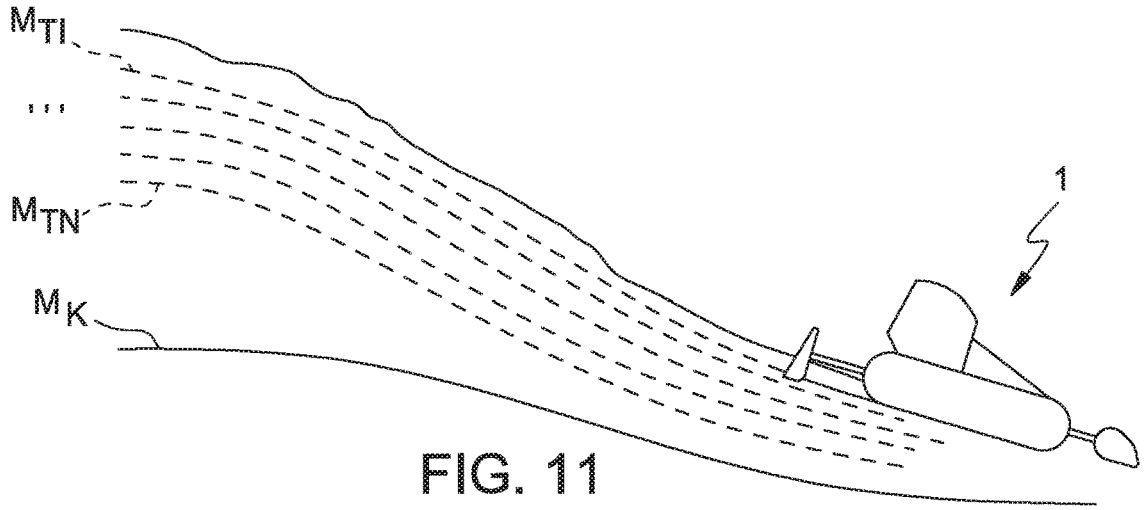
FIG. 11 is a schematic representation of maps stored in the control system of FIG. 10.
Figure 13:
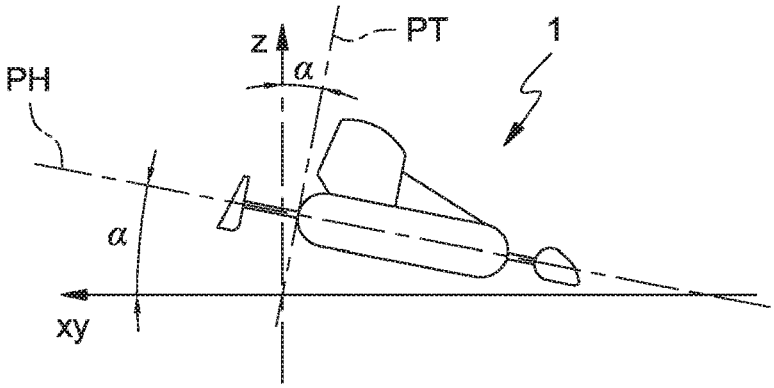
FIGS. 13 to 15 show quantities used in an embodiment of the control method according to the disclosure.
Figure 14:
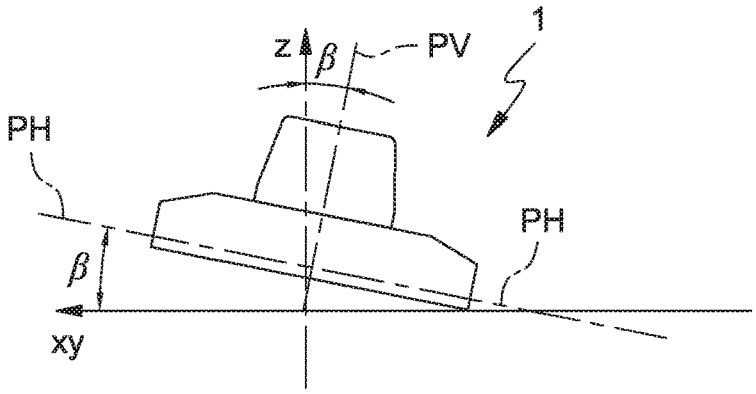
Figure 15:
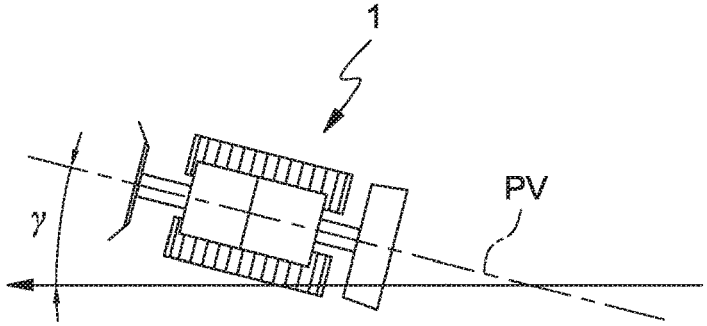

Furthermore, the using devices, in particular the blade 8 through the actuators 25-28 and the tiller and finisher assembly 9 through the actuators 50, may be automatically controlled by the control system 15. To this purpose, the control system 15 comprises, in certain embodiments, a processing unit 30, a memory device 31, a control interface 32 and a communication interface 33 (FIG. 10).

The processing unit 30 is configured to determine an ideal position of the using devices, in particular of the blade 8, and to operate (among others) the actuators 25-28 of the blade 8 based on target maps $M_{T1}, \ldots, M_{TN}$ stored in the memory device 31 and representing desired surfaces to be obtained from the processing of the snowpack. The target maps $M_{T1}, \ldots, M_{TN}$, in particular, may represent the ideal surface of a ski slope, which is normally characterized by surface regularity and uniformity in the consistency of the snowpack, as well as the surface of a snowpark structure, with a special shape. Furthermore, the target maps $M_{T1}, \ldots, M_{TN}$ may represent intermediate target surfaces between a current target surface and the current surface of the snowpack of the area to be treated. Especially for snowpark structures, which may be particularly complicated, the processing of the snow surface can be carried out in an iterative manner. The objective maps $M_{T1}, \ldots, M_{TN}$ may be produced in a remote calculation centre and be loaded into the memory device 31 through the communication interface 33.

In detail, the processing unit 30, in a first step, uses a model of the snow groomer vehicle to determine:

- position, orientation and travelling direction of the snow groomer vehicle 1 (for example of the frame 2);
- lifting angle, vertical tilt angle, lateral tilt angle, cutting angle of the blade 8 relative to the frame 2, which are deemed to be ideal for obtaining the currently selected current target surface $M_{TK}$.

In a second step, the processing unit 30 determines and applies control signals to the actuators 25-28 through the control interface 32, so as to place the blade 8 in the previously determined configuration. More precisely, the processing unit 30 provides the control interface 32 with parameters indicating a target configuration of the blade 8 (for example target values $\delta_T$, $\varepsilon_T$, $\eta_T$ of a lifting angle $\delta$, of a vertical tilt angle $\varepsilon$ and of a lateral tilt angle $\eta$, which will be defined more in detail below) and applies controls to the actuators 25-28 in order to set and maintain the objective values of the configuration parameters received.

For the sake of simplicity, in order to define the relative positions of the elements of the snow groomer vehicle 1, hereinafter we will use (FIGS. 1, 2 and 12 to 15):

- a longitudinal middle plane PV, which contains the longitudinal axis A of the frame 2 and is perpendicular to the rotation axis R1 (and, hence, is vertical when the snow groomer vehicle 1 is on a horizontal surface); the longitudinal plane PV longitudinally divides the snow groomer vehicle into two substantially symmetric parts.
- a plane PT perpendicular to the plane PV, containing the rotation axis R1 and perpendicular to the longitudinal axis A of the frame 2;
- a plane PH perpendicular to the plane PV and to the plane PT and containing the rotation axis (and, hence, horizontal when the snow groomer vehicle 1 is on a horizontal surface);
- a fixed reference system Oxyz, for example with a horizontal plane xy and a vertical axis z (i.e., a reference system which is fixed in the space and where the map M of the ski slope to be treated is located); and
- a relative reference system O'x'y'z', having origin O' in a hinge between the frame 2 and the rigid structure 22 (for example, in a middle plane of the frame 2 perpendicular to the hinge axis) and axes x', y', z' defined by the intersections of the planes PH, PT, of the planes PV, PH and of the planes PV, PT, respectively.

Furthermore, we will use:

- a longitudinal tilt angle $\alpha$ of the frame 2 (and of the reference system O'x'y'z'), which is defined between the axis Z and the plane PT;
- a lateral tilt angle $\beta$ of the frame 2 (and of the reference system O'x'y'z'), which is defined between the axis Z and the plane PV;
- an azimuth angle $\gamma$ of the frame 2 (and of the reference system O'x'y'z'), which is defined between the axis Y and the plane PV and determines the travelling direction of the snow groomer vehicle in the travelling plane;
- a lifting angle $\delta$, which defines the inclination of the rigid structure 22 relative to the plane PH;
- a vertical tilt angle $\varepsilon$ of the blade 8, which defines an inclination of the blade 8 in a vertical plane, when the snow groomer vehicle is on a horizontal ground;
- a lateral tilt angle $\eta$ of the blade 8, which defines an inclination of the blade 8 in a horizontal plane, when the snow groomer vehicle is on a horizontal ground;
- a cutting angle $\theta$ of the blade 8.

Figure 16:
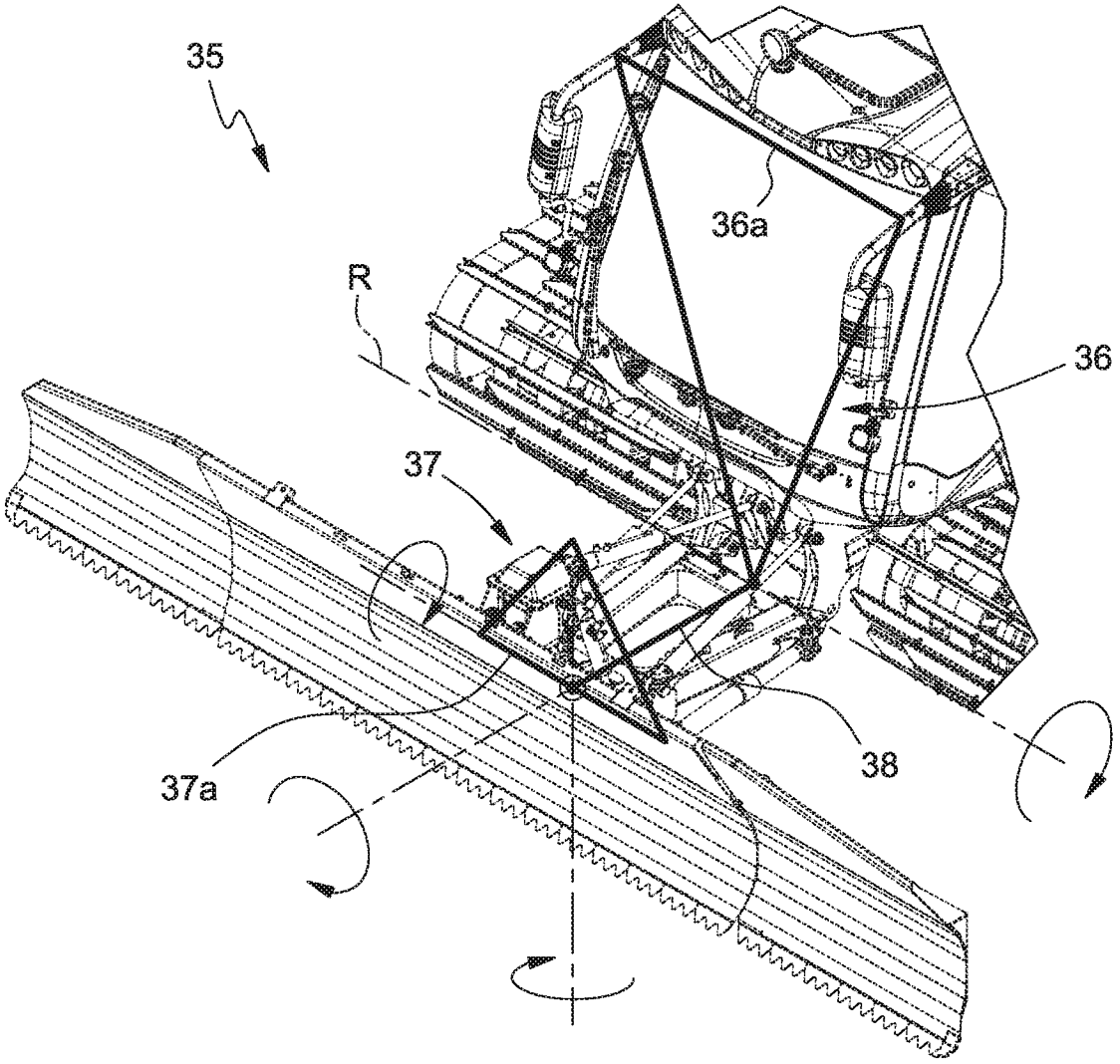
FIG. 16 is a diagram showing a model of the snow groomer vehicle used in an embodiment of the control method according to the disclosure.

The model of the snow groomer vehicle 1, indicated with number 35 in FIG. 16, is defined by geometric elements, which determine the position and the orientation of the frame 2, of the rigid structure 22 and of the blade 8. More in detail, the frame 2 is schematically represented by an isosceles triangle 36 having a base 36*a* parallel to the rotation axis R of the rigid structure 22 and a vertex coinciding, for example, with the rotation axis R. The blade 8 is schematically represented by a further triangle 37, which is also an isosceles triangle. The rigid structure 22 is schematically represented by a segment 38 having a first end hinged to the frame 2 in a position corresponding to the vertex of the triangle 36 and capable of rotating around the rotation axis R. A second end of the segment 38 is connected to a middle point of the base 37*a* of the triangle 37 defining the blade 8 with three rotary degrees of freedom (corresponding to vertical tilt, cutting angle and lateral tilt, respectively), so as to simulate the universal joint 24. Furthermore, the actuators 25-28 are defined by as many hydraulic cylinders in corresponding positions.

The positions and orientations of the triangles 36, 37 and the segment 38 completely define, in a two-way manner, the relative positions of the frame 2, of the rigid structure 22 and of the blade 8.

The model may comprise admissible value ranges for the lifting angle $\delta$, the vertical tilt angle E and the lateral tilt angle $\eta$ of the blade 8. The admissible value ranges are determined by the mechanical constraints of the connection between the blade 8 and the frame 2. The processing unit 30 is configured to limit the actuation of the movements of the blade 8 within the admissible value ranges. In case the limits of the admissible ranges are exceeded, the processing unit 30 can generate an alarm signal and/or force the shift to a manual control mode, directly under the control of the operator.

Figure 17:
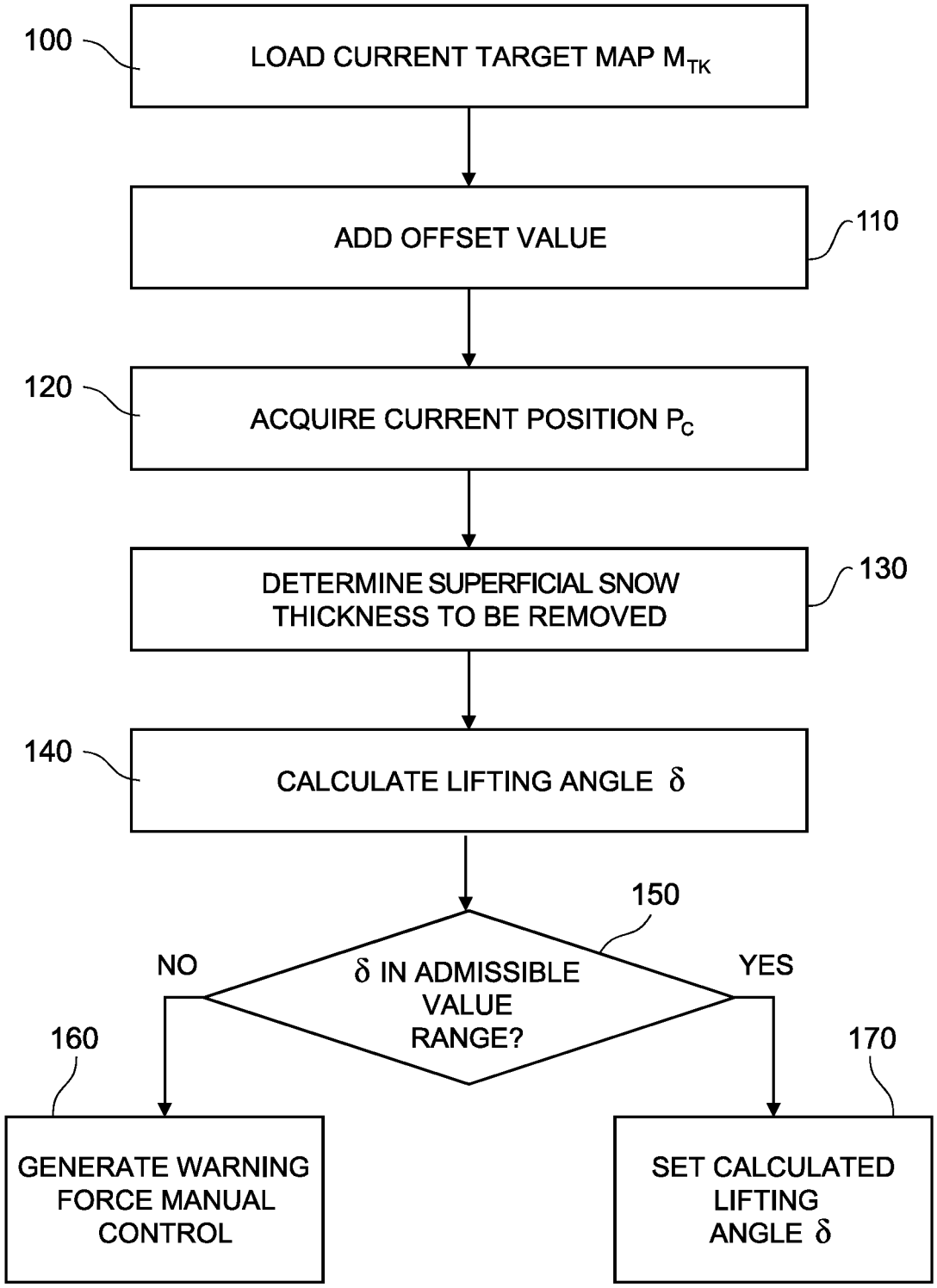
FIG. 17 is a flowchart concerning an embodiment of the control method according to the disclosure.

In order to determine the lifting angle $\delta$, the processing unit operates as described below, with reference to FIG. 17.

At first (block 100), the processing unit 30 loads a current target map $M_{TK}$ defining the surface of the snowpack to be obtained at the end of the current processing steps (for example, in case of snowpark structures, the processing can require numerous steps, each corresponding to a respective current target map $M_{TK}$). If necessary (block 110), the processing unit adds an offset value to take into account possible variations in the thickness of the snowpack due to precipitations, snow melting, erosions caused by the passage of skiers and so on.

Then, the processing unit 30 acquires its current position $P_C$ from the satellite navigation device 13 (block 120). The current position $P_C$ includes the height from the ground at the corresponding coordinates of the map M of the ground and, therefore, takes into account the actual thickness of the snowpack. Furthermore, the processing unit 30 determines the azimuth angle $\gamma$ (the axis x' of the reference system O'x'y'z' is parallel to the height of the triangle 36 shaping the frame 2) and the longitudinal tilt angle $\alpha$. Therefore, the orientation of the frame 2 is determined, as well.

Figure 18:
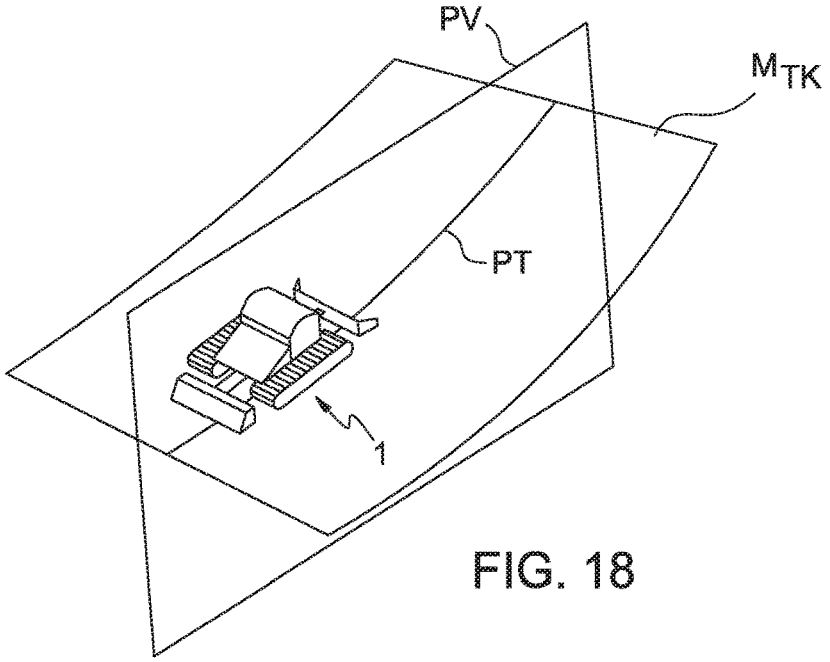
FIG. 18 shows geometric entities used in an embodiment of the control method according to the disclosure.

From the current position $P_C$ and from the current target map $M_{TK}$ the processing unit 30 determines the superficial snow thickness to be removed in every position along the trajectory of the snow groomer vehicle 1 (block 130). More in detail, the processing unit 30 calculates the intersection of the current target map $M_{TK}$ used and of the plane PV, where the segment 38 shaping the rigid structure 22 also lies. This intersection defines the target profile PT in the travelling direction of the snow groomer vehicle 1 (FIG. 18). Then, the processing unit 30 determines the superficial snow thickness to be removed from the height difference between the target profile PT at the coordinates of the snow groomer vehicle 1 and the height of the snow groomer vehicle 1 determined by the satellite navigation device 13.

Subsequently (block 140), the processing unit 30 calculates the lifting angle δ to be set in order to obtain the removal of the previously determined snow thickness. The lifting angle δ is determined by the intersection between the trajectory in the plane PV of the end of the segment 38 opposite to the rotation axis R1 and the target profile PT. Said end corresponds to the universal joint 24 between the rigid structure 22 and the blade 8 and its trajectory develops along a circumference, as a function of the lifting angle δ. Therefore, the intersection between the trajectory of the end of the segment 38 and the target profile PT provides the desired lifting angle δ corresponding to the removal of the previously determined snow thickness.

If the lifting angle δ exceeds a programmed range of admissible values (block 150, NO output), the processing unit 30 generates a warning signal and/or forces the shift to the manual control by the operator (block 160).

In a contrary case (block 150, YES output), the processing unit 30 acts upon the actuators 25 so as to set the calculated lifting angle δ (block 170). In certain embodiments, in particular, the actuators 25 are hydraulic cylinders and the processing unit 30 determines the length of the actuators 25 needed to obtain the desired lifting angle δ.

Figure 19:
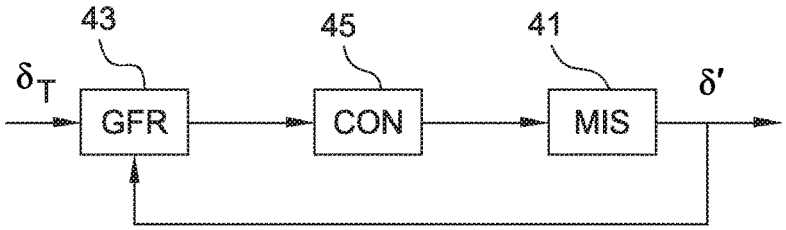
FIG. 19 is a more detailed block diagram concerning a portion of the control system of FIG. 10.

The control system 15 comprises a feedback control device 40 (FIG. 19), for example implemented by the control interface 32, which operates so as to maintain the set length of the actuators 25 and the set lifting angle δ, avoiding deviations from the ideal position. The feedback control device 40 comprises a measuring module 41, a comparison module 43 and a control module 45. The measuring module 41 detects a current quantity δ' indicating the lifting angle δ, which can be a direct measure of the lifting angle δ relative to a reference, for example by an encoder, or an indirect measure, such as a measure of the length of the actuator 25. The comparison module 43 calculates a difference between the parameter measured by the measuring module 41 and a target parameter $\delta_T$ representing the lifting angle calculated by the processing unit 30. The control module 45 determines a control action based on the difference between the current quantity δ' and the target parameter $\delta_T$ (for example with a PID control) and applies it to the actuator 25 in order to cancel the variations of the actual lifting angle δ. The control action can be carried out through the pressure delivered to the actuator 25 (hydraulic cylinder).

The processing unit 30 determines the vertical tilt angle ε, the lateral tilt angle η and the cutting angle θ of the blade 8 in a similar manner.

Figure 20:
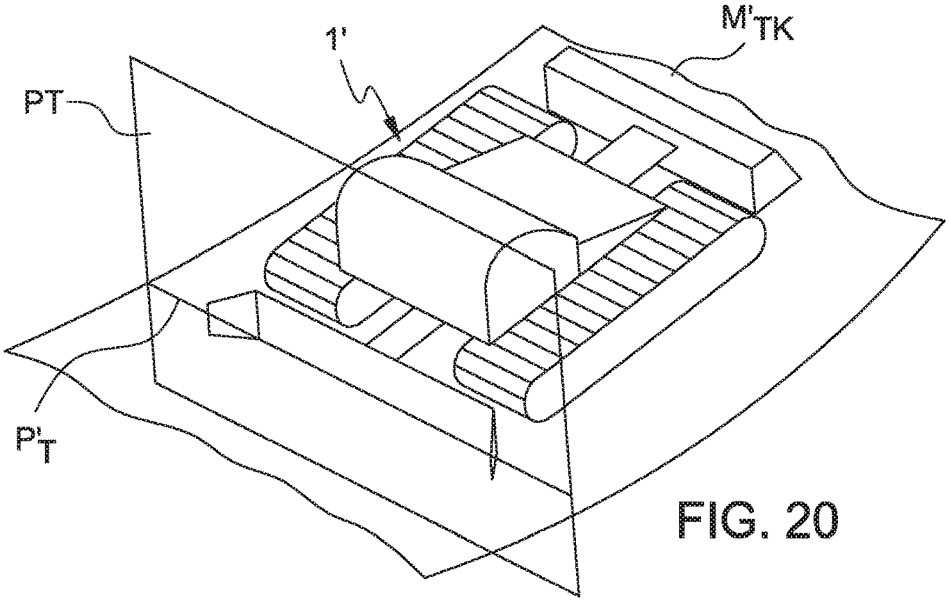
FIGS. 20-25 show further geometric entities used in an embodiment of the control method according to the disclosure.

As far as the vertical tilt angle ε (FIG. 20) is concerned, in certain embodiments, the processing unit 30 determines a target profile PT' defined by the intersection of the current target map $M_{TK}$ with a plane, which is parallel to the plane PT and goes through a point corresponding to the end of the segment 38 connected to the triangle 37 (which shape the rigid structure 22 and the blade 8, respectively). This intersection corresponds to a position of the universal joint 24 and defines the position of the centre of the blade 8. The processing unit 30 calculates the differences in level between the opposite ends of the base **36*a* of the triangle 36 and corresponding points of the target profile PT' and, from there, the vertical tilt angle ε needed to make up for the lateral inclination of the ground to be prepared relative to the snow groomer vehicle 1 (in particular, relative to the plane PH). The vertical tilt angle ε determined by so doing is set by the actuators 26 and is maintained through a feedback control system, which is similar to the system 40 of FIG. 19**.

The processing unit 30 is also configured to control the lateral tilt angle η of the blade 8.

The memory device 31 contains programmed optimal trajectories $T_T$, which may be selected in order to obtain the profiles defined in the target maps $M_T, \ldots, M_N$. In certain embodiments, the optimal trajectories $T_T$ may be defined by sequences of coordinates corresponding to respective portions of one or more ski slopes of a ski resort. The control unit 30 is also configured to guide a snow groomer vehicle 1 along the optimal trajectories $T_T$ acting upon the controls of the drive unit 5, of the powertrain 12 and of the tracks 6. To this purpose, in certain embodiments, the control unit 30 compares the current coordinates determined by the satellite navigation device 13 with the selected optimal trajectory $T_T$. In case there is a difference between the determined current coordinates and the selected optimal trajectory $T_T$, the control unit 30 acts upon the controls of the drive unit 5, of the powertrain 12 and of the tracks 6 so as to cancel the difference and tends to bring the snow groomer vehicle 1 back on the optimal trajectory $T_T$. Furthermore, the travelling speed can be set by the control unit 30 as a function of the position along the optimal trajectory $T_T$, of the features of the ground (for example, the gradient) and of the type of processing of the snowpack to be carried out. In some embodiments, the optimal trajectories $T_T$ may be defined so as to cause the snow groomer vehicle to drive numerous times on a relatively restricted area in order to create structures dedicated to the execution tricks, such as kicker and landing ramps with different degrees of difficulty, bumps, half-pipes and so on. In other embodiments, the optimal trajectories $T_T$ may be defined so as to cover larger portions of a ski resort, for example the entire path of one or more ski slopes. Accordingly, the profiles defined in the target maps $M_T, \ldots, M_N$ are more regular and generally require a smaller number of passages in order to obtain the desired effect. Furthermore, the results can usually be obtained by setting less incisive configurations of the blade 8. In any case, the control system 15 is capable of automatically carrying out, with the same principles, both the processing of snowpark structures and the normal preparation of the ski slopes of a ski resort, using—in order to do so—programmed optimal trajectories $T_T$ and the controls of the drive unit 5, of the powertrain 12 and of the tracks 6. The optimal trajectories $T_T$, in particular, can be chosen so as to optimize preparation times and resource consumption.

Figure 21:
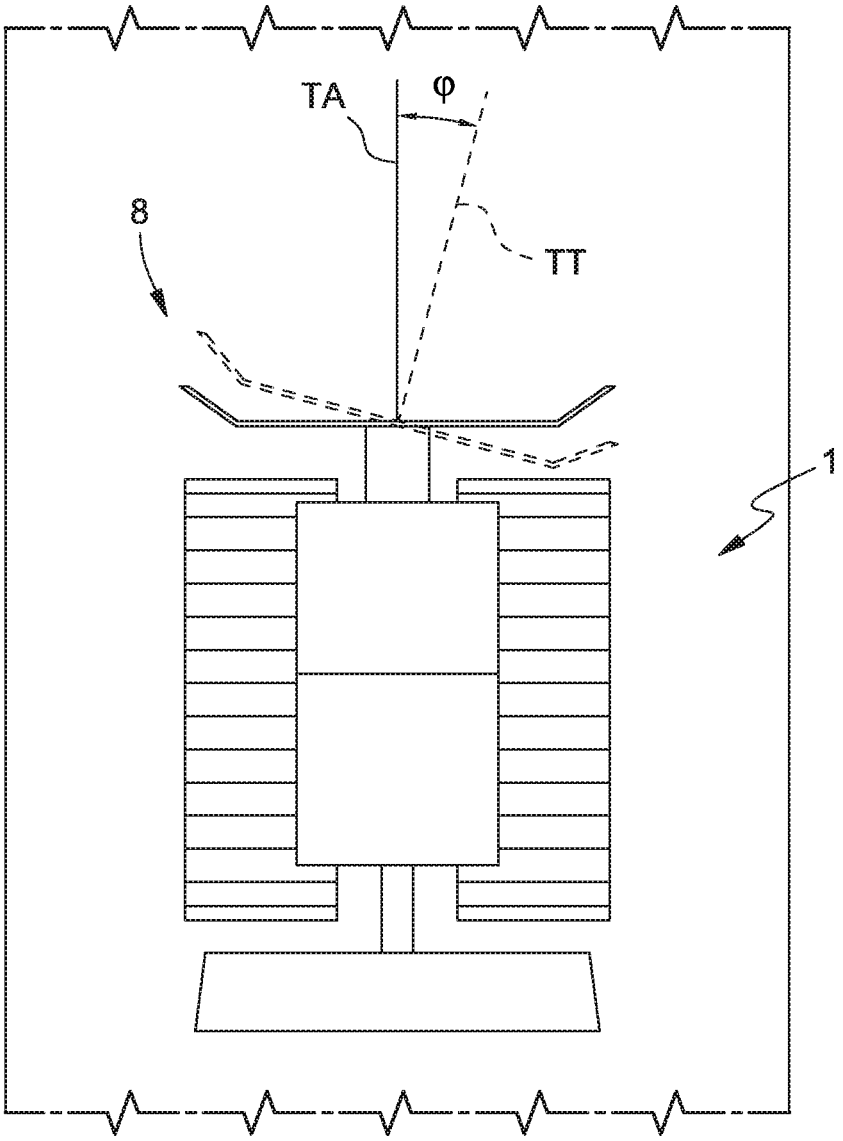

The processing unit 30 acts upon the lateral tilt angle η in order to make up for the incorrect positioning of the blade 8 due to differences between the actual trajectory TA of the snow groomer vehicle 1 and the ideal trajectories $T_T$ and in order to keep the orientation of the work front constant (FIG. 21). To this purpose, the processing unit 30 compares the actual orientation of the snow groomer vehicle 1 (represented by the triangle 36 and defined by the azimuth angle γ) with the projection of the currently selected optimal trajectory $T_T$ onto the plane PH. If there is an angular deviation φ between the orientation of the snow groomer vehicle 1 and the optimal trajectory $T_T$ selected, the processing unit 30 corrects the lateral tilt of the blade 8, forcing, through the actuators 28, a lateral tilt angle η which is equal to the angular deviation φ. In the model, the lateral tilt of the blade 8 is defined by the orientation of the base 37*a* of the triangle 37.

Furthermore, the processing unit 30 is configured to control the configuration of the tiller and finisher assembly 9 through the actuator assembly 50. In particular, the processing unit 30 controls an orientation f the tiller and finisher assembly 9 relative to the frame 2 (FIG. 22); a lateral offset of the tiller and finisher assembly 9 (FIGS. 23 and 24); and a cutting angle χ of the tiller and finisher assembly 9, basically rotating the tiller and finisher assembly 9 relative to the rigid structure 29 around the rotation axis R4, which is parallel to the plane PH and, when the tiller and finisher assembly 9 is aligned with the frame 2, is parallel to the rotation axis R2 (FIGS. 2 and 25).

Figure 22:
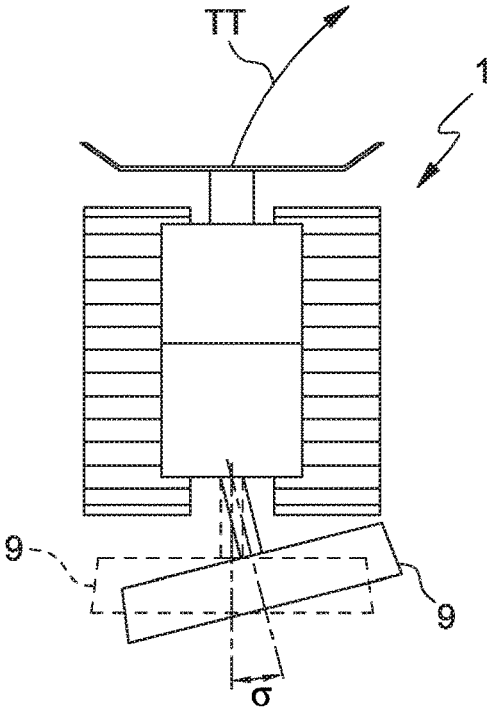

In detail, as far as the orientation of the tiller and finisher assembly 9 relative to the frame 2 is concerned, the processing unit 30 determines a towing angle θ between the vertical middle plane PV and the rear connecting device 21 (FIG. 22). In an operating mode, the towing angle θ is fixed, so that the tiller and finisher assembly extends crosswise to the trajectory of the snow groomer vehicle 1. In a different operating mode, the towing angle θ is determined by the processing unit 30 based on the current target map $M_{TK}$ (which defines a model of the slope following the passage of the snow groomer vehicle 1), on the curvature of a currently selected one of programmed trajectories $T_P$ stored in the memory device 31 and on position, orientation and travelling direction of the snow groomer vehicle 1. In other words, the programmed trajectory $T_P$ may have straight segments and curved segments, with a curvature which is defined by the geometry of the programmed trajectory $T_P$ itself. The processing unit 30 acquires the position from the satellite navigation device 13 and sets the towing angle θ as a function of the geometric features of the programmed trajectory $T_P$ in the position currently occupied by the snow groomer vehicle 1, so that the tiller and finisher assembly 9 maintains a programmed orientation relative to the programmed trajectory $T_P$ (however, the orientation of the tiller and finisher assembly 9 relative to the programmed trajectory $T_P$ can be changed along the path depending on the slope preparation preferences). This type of control helps carry out the desired preparation even when the snow groomer vehicle 1 drives along sharp bends (for example, in U-turns). In a further operating mode, the tiller and finisher assembly 9 floats around the rotation axis R3 and, therefore, the towing angle θ basically adjusts to the ground.

Figure 23:
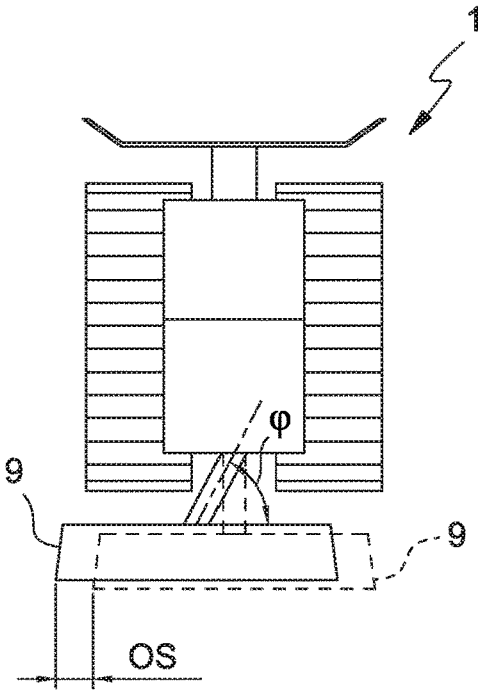
Figure 24:
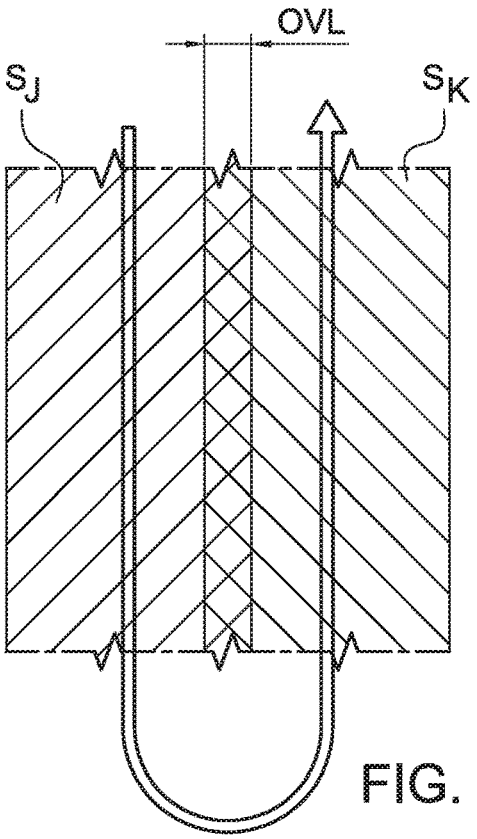

The lateral offset OS of the tiller and finishers assembly 9 relative to the snow groomer vehicle 1 is controlled by the processing unit 30 by setting the towing angle θ and a yaw angle ψ of the tiller and finisher assembly 9, namely the angle between the direction of the largest size of the tiller and finisher assembly 9 and a middle axis of the rear connecting device 21 (FIG. 23). In particular, in an operating mode, the towing angle θ and the yaw angle ψ are controlled in a coordinated manner, so that the tiller and finisher assembly 9 is translated in a parallel manner without changing its orientation relative to the frame 2 of the snow groomer vehicle 1. Furthermore, in an operating mode, the processing unit 30 controls the lateral offset OS as a function of the programmed trajectory $T_P$ and of the position of the snow groomer vehicle 1, so as to obtain a programmed overlap OVL between adjacent processing strips SJ, SK (FIG. 24). In some cases, such as in the preparation of ski slopes or ski slope portions, the programmed trajectory $T_P$ is defined so as to cover the entire width of the slope with different passages in a longitudinal direction along adjacent processing strips SJ, SK substantially as large as the snow groomer vehicle 1. Generally speaking, a given overlap between adjacent processing strips SJ, SK is wanted in order to avoid having untreated ski slope portions. However, the degree of overlap should be as small as possible in order to optimize the travel. The processing unit 30 controls the lateral offset OS by setting the towing angle θ4 and the yaw angle ψ. In this way, possible deviations from the programmed trajectory $T_P$ detected by the satellite navigation device 13 can be compensated and, therefore, the degree of overlap between adjacent processing strips SJ, SK can be minimized.

Figure 25:
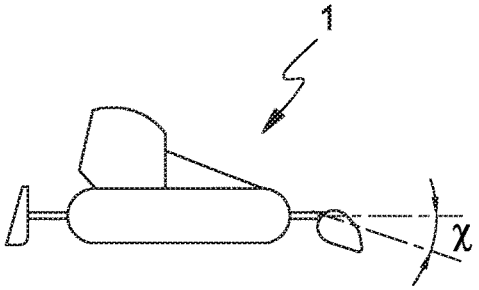

In a further operating mode, the processing unit 30 determines the cutting angle χ so as to control the processing depth of the tiller and finisher assembly 9, basically rotating the rigid structure 29 around the rotation axis R4 (FIG. 25). In particular, the cutting angle χ is defined starting from the current target map $M_{TK}$ (which defines the snowpack surface to be obtained at the end of the current processing step) and from the position of the snow groomer vehicle 1 detected by the satellite navigation device 13, so as to obtain the desired profile.

The processing unit 30 is further configured to adopt safety measures when the snow groomer vehicle 1 is subjected to an excessive load, for example due to an excessive quantity of snow being moved, also taking into account the gradient of the ground. Said excessive load conditions can be automatically detected by the processing unit 30, for example when the drive unit 5 is close to the stall or the powertrain 12 is in pressure cutoff.

Furthermore, the processing unit 30 is configured to intervene in case of overload, adopting one or more of the following actions:

- changing the work point of the drive unit 5, reducing the overload, actually operating as a limiter;
- changing the cutting angle θ of the blade 8 through the actuator 27, so as to reduce the weight of the snow being moved;
- generating warning signals;
- forcing the shift to manual control.

In certain embodiments, the snow groomer vehicle according to the disclosure can be provided with further detectors aimed at determining, with greater precision, the environmental conditions in which the snow groomer vehicle is and, as consequence, aimed at determining the ability to operate in an autonomous manner. The snow groomer vehicle can be equipped with radar or lidar sensors, stereo cameras and the like communicating with the processing unit, which can be configured to carry out actions in response to the conditions detected by the sensors. For example, the processing unit can use the information of the sensors to recognize the presence of fixed obstacles (irregularities in the ground, trees, rocks, slopes, power towers, snow guns, protection nets and the like) or moving obstacles (e.g., skiers) along the trajectory of the snow groomer vehicle and react with suitable actions (stopping the snow groomer vehicle, deflecting from the set trajectory, changing the configuration of the blade or of the tiller and finisher assembly).

Finally, the snow groomer vehicle and the method described and claimed herein can evidently be subjected to changes and variations, without for this reason going beyond the scope of protection set forth in the appended claims. That is, the present disclosure also covers embodiments not described in the detailed description and equivalent embodiments, which fall within the scope of protection of the appended claims. As such, the scope of protection of the present disclosure is defined by the claims which cover variants not specifically described and equivalent embodiments. Accordingly, various changes and modifications to the presently disclosed embodiments will be apparent to those skilled in the art.

The invention claimed is:

1. A snow groomer vehicle comprising:

a frame extending along a longitudinal axis;

a tool comprising a blade connected to the frame through a connecting device comprising a front connecting device connecting the blade to the frame, the connecting device equipped with an actuator assembly configured to determine a relative position of the tool with respect to the frame, wherein:

the front connecting device comprises a front rigid structure rotatably hinged to the frame about a front rotation axis, and a universal joint connecting the blade to the front rigid structure, and the actuator assembly comprises a first actuator unit configured to rotate the front rigid structure about the front rotation axis to lift and lower the blade, a second actuator unit configured to rotate the blade to create a difference in level between opposite ends of the blade, a third actuator unit configured to tilt the blade, and a fourth actuator unit configured to move the blade in a first direction perpendicular to a travelling direction, and in a second direction at an angle with respect to the travelling direction;

a satellite navigation device; and a control system comprising:

a memory device storing data associated with a target map representing a surface to be obtained by processing a snowpack over a region, and a processing unit configured to use data associated with a simplified model of the snow groomer vehicle comprising a first polygon representing the frame and having a side parallel to the front rotation axis and a vertex coinciding with the front rotation axis, a second polygon representing the blade, and a segment representing the front rigid structure and having a first end hinged at the vertex of the first polygon and a second end connected to a midpoint of a base of the second polygon with three rotary degrees of freedom to:

determine, based on data provided by the satellite navigation device, a current position of the frame and a current orientation of the frame, determine a configuration for the tool based on the current position of the frame, the current orientation of the frame and the target map, and cause the actuator assembly to move the tool into the determined configuration such that a passage of the tool causes a modification of the snowpack that conforms the snowpack to the target map.

2. The snow groomer vehicle of claim 1, wherein:

the processing unit is configured to provide configuration parameters indicating a target configuration of the blade, and the control system includes a control interface configured to:

receive the configuration parameters, and apply commands to the actuator assembly to set the received configuration parameters.

3. The snow groomer vehicle of claim 2, wherein the control system comprises a feedback control device configured to cause the actuator assembly to maintain the configuration parameters.

4. The snow groomer vehicle of claim 1, wherein the processing unit is configured to determine a first target profile in the travelling direction as an intersection of the target map and a first reference plane of the frame perpendicular to the front rotation axis.

5. The snow groomer vehicle of claim 4, wherein the processing unit is configured to calculate a front lifting angle of the blade relative to the frame about the front rotation axis from an intersection of the first target profile and a trajectory in the first reference plane of an end of the front rigid structure opposite to the frame.

6. The snow groomer vehicle of claim 5, wherein the processing unit is configured to:

determine a second target profile as an intersection of the target map with a plane parallel to a second reference plane containing the front rotation axis and perpendicular to the longitudinal axis of the frame, calculate differences in level between opposite ends of the blade and corresponding points of the second target profile with the calculated front lifting angle of the blade, and calculate a vertical inclination angle of the blade from the differences in level, wherein the vertical inclination angle of the blade defines an inclination of the blade in a vertical plane when the snow groomer vehicle is on horizontal ground.

7. The snow groomer vehicle of claim 1, wherein the processing unit is configured to determine a vertical inclination angle of the blade defining an inclination of the blade in a vertical plane when the snow groomer vehicle is on horizontal ground.

8. The snow groomer vehicle of claim 1, wherein the processing unit is configured to determine a lateral inclination angle defining an inclination of the blade in a horizontal plane when the snow groomer vehicle is on horizontal ground.

9. The snow groomer vehicle of claim 8, wherein:

the memory device stores optimal trajectories programmed to obtain a target profile defined in the target map, and the processing unit is configured to:

detect an angular deviation between the current orientation of the frame and a currently selected optimal trajectory, and correct the lateral inclination angle based on the angular deviation detected.

10. The snow groomer vehicle of claim 1, wherein the memory device stores a plurality of target maps representing respective surfaces to be obtained by iterations of processing of the snowpack.

11. The snow groomer vehicle of claim 1, wherein the tool comprises a tiller and finisher assembly and the connecting device comprises a rear connecting device connecting the tiller and finisher assembly to the frame.

12. The snow groomer vehicle of claim 11, wherein the processing unit is configured to control a towing angle of the tiller and finisher assembly relative to the frame based on: (i) the target map, (ii) a curvature of a currently selected one of a plurality of programmed trajectories stored in the memory device, (iii) the travelling direction, (iv) the current position of the frame and (v) the current orientation of the frame, such that the tiller and finisher assembly maintains a programmed orientation with respect to the currently selected programmed trajectory.

13. The snow groomer vehicle of claim 12, wherein the processing unit is configured to set the towing angle of the tiller and finisher assembly and a yaw angle of the tiller and finisher assembly to control a lateral offset of the tiller and finisher assembly.

14. The snow groomer vehicle of claim 13, wherein the processing unit is configured to control the lateral offset based on the currently selected programmed trajectory and the current position of the frame to obtain a programmed overlap between adjacent processing strips.

15. The snow groomer vehicle of claim 11, wherein the processing unit is configured to determine a cutting angle of the tiller and finisher assembly based on the target map and the current position of the frame.

16. A method of operating a snow groomer vehicle comprising a frame extending along a longitudinal axis and a tool comprising a blade connected to the frame through a connection device comprising a front connecting device connecting the blade to the frame, the connecting device equipped with an actuator assembly configured to determine a relative position of the tool with respect to the frame wherein the front connecting device comprises a front rigid structure rotatably hinged to the frame about a front rotation axis. and a universal joint connecting the blade to the front rigid structure, the method comprising:

defining a target map representing a surface to be obtained by processing a snowpack over a region;

defining a simplified model of the snow groomer vehicle comprising:

a first polygon representing the frame and having a side parallel to the front rotation axis and a vertex coinciding with the front rotation axis, a second polygon representing the blade, and a segment representing the front rigid structure and having a first end hinged at the vertex of the first polygon and a second end connected to a midpoint of a base of the second polygon with three rotary degrees of freedom;

determining a current position of the frame and a current orientation of the frame;

determining a configuration for the tool based on the current position of the frame, the current orientation of the frame, and the target map, wherein the determination comprises determining a first target profile in a travelling direction as an intersection of the target map and a first reference plane of the frame perpendicular to the front rotation axis; and moving the tool into the determined configuration such that a passage of the tool causes a modification of the snowpack that conforms the snowpack to the target map.

17. The method of claim 16, wherein determining the configuration of the tool comprises determining a lateral inclination angle of the blade that defines a blade angle in a horizontal plane when the snow groomer vehicle is on horizontal ground.

18. The method of claim 17, wherein determining the lateral inclination angle comprises:

defining optimal trajectories to obtain profiles defined in the target map, detecting an angular deviation between the current orientation of the frame and a currently selected optimal trajectory, and correcting the lateral inclination angle of the blade based on the angular deviation detected.

19. The method of claim 16, wherein determining the configuration of the tool comprises calculating a front lifting angle of the blade relative to the frame about the front rotation axis from an intersection between the first target profile and a trajectory in the first reference plane of an end of the front rigid structure opposite to the frame.

20. The method of claim 19, wherein:

determining the configuration of the tool comprises determining a vertical inclination angle of the blade defining an inclination of the blade in a vertical plane when the snow groomer vehicle is on horizontal ground, and determining the vertical inclination angle of the blade comprises:

determining a second target profile as an intersection of the target map with a plane parallel to a second reference plane containing the front rotation axis and perpendicular to the longitudinal axis of the frame, calculating differences in level between opposite ends of the blade and corresponding points of the second target profile with the calculated front lifting angle of the blade, and calculating the vertical inclination angle from the differences in level.

21. The method of claim 16, wherein determining the configuration of the tool comprises determining a vertical inclination angle of the blade defining an inclination of the blade in a vertical plane when the snow groomer vehicle is on horizontal ground.

22. The method of claim 16, wherein the tool comprises a tiller and finisher assembly and the connecting device comprises a rear connecting device connecting the tiller and finisher assembly to the frame.

23. The method of claim 22, further comprising controlling a towing angle of the tiller and finisher assembly with respect to the frame based on:

(i) the target map, (ii) a curvature of a currently selected programmed trajectory from a plurality of programmed trajectories, (iii) the travelling direction, (iv) the current position of the frame, and (v) the current orientation of the frame, such that the tiller and finisher assembly maintains a programmed orientation with respect to the currently selected programmed trajectory.

24. The method of claim 23, further comprising setting the towing angle of the tiller and finisher assembly and a yaw angle of the tiller and finisher assembly to control a lateral offset of the tiller and finisher assembly.

25. The method of claim 24, wherein the lateral offset is controlled based on the currently selected programmed trajectory and the current position of the frame to obtain a programmed overlap between adjacent processing strips.

26. The method of claim 23, further comprising determining a cutting angle of the tiller and finisher assembly based on the target map and the current position of the frame.

* * * * *